United States Patent [19]

Johnson et al.

[11] Patent Number: 4,858,822

[45] Date of Patent: Aug. 22, 1989

[54] PREFABRICATED GIFT BOX

[75] Inventors: Larry B. Johnson, Colleyville; Thomas K. Curtis, Jr., Dallas; Gary A. Allred, Grand Prairie, all of Tex.

[73] Assignee: Carousel Investment Corporation, Irving, Tex.

[21] Appl. No.: 237,052

[22] Filed: Aug. 29, 1988

[51] Int. Cl.[4] ..... B65D 5/06

[52] U.S. Cl. ..... 229/137; 229/8; 229/41 B; 229/138; 229/922

[58] Field of Search ..... 229/8, 40, 41 R, 41 B, 229/137, 138, 143, 922, 923; 206/457

[56] References Cited

U.S. PATENT DOCUMENTS

| | | | |
|---|---|---|---|
| 2,667,711 | 2/1954 | Anderson | 229/87 R |
| 2,930,517 | 3/1960 | Mensing et al. | 229/41 B |
| 3,285,402 | 11/1966 | Gordun | 229/40 |
| 3,311,289 | 3/1967 | French | 383/120 |
| 3,315,868 | 4/1967 | Hempfling | 229/40 |
| 3,317,116 | 5/1967 | Persson | 229/137 |
| 3,322,324 | 5/1967 | Persson | 229/138 |
| 3,343,750 | 9/1967 | Desmond et al. | 229/138 |
| 3,381,889 | 5/1968 | Laskow | 229/40 |
| 3,391,856 | 7/1968 | Siegler | 229/923 |
| 3,434,645 | 3/1969 | Prisco | 229/8 |
| 3,458,112 | 7/1969 | Nelson | 229/40 |
| 3,495,760 | 2/1970 | Poth | 229/40 |
| 3,499,598 | 3/1970 | Foley et al. | 229/923 |
| 3,627,541 | 12/1971 | Farqunar | 229/40 |
| 3,658,240 | 4/1972 | Stoll | 229/40 |
| 3,677,144 | 7/1972 | Hudson | 229/40 |
| 3,682,370 | 8/1972 | Rous | 229/40 |
| 3,743,171 | 7/1973 | Nederveld | 229/40 |
| 3,790,069 | 2/1974 | Straccamore | 206/45.33 |
| 4,005,814 | 2/1977 | Foster | 229/923 |
| 4,130,237 | 12/1978 | Struble | 229/40 |
| 4,216,861 | 8/1980 | Oliff | 229/40 |
| 4,326,665 | 4/1982 | Scott | 229/40 |
| 4,340,169 | 7/1982 | Webinger | 229/41 B |
| 4,396,118 | 8/1983 | Watson | 229/40 |
| 4,445,634 | 5/1984 | Sato | 229/40 |
| 4,458,836 | 7/1984 | Wood | 229/40 |
| 4,560,102 | 12/1985 | Dlugopolski | 229/40 |
| 4,690,321 | 9/1987 | Spaeth | 229/40 |
| 4,712,726 | 12/1987 | Fonas | 229/8 |
| 4,785,993 | 11/1988 | Lisiecki | 229/137 |

*Primary Examiner*—Gary Elkins

*Attorney, Agent, or Firm*—Michael A. O'Neil

[57] ABSTRACT

A box, formed from a single rectangular blank of a suitable material, suitable for packaging gift items, having a unique construction wherein score lines and perforated score lines are used to form an end closure section permitting the box to be rapidly and easily assembled. The rectangular blank from which the box is made may be coated or overlaid on one or both sides with a decorative finish so that the box, when assembled, presents the appearance of a conventionally gift-wrapped package.

6 Claims, 4 Drawing Sheets

Fig. 9
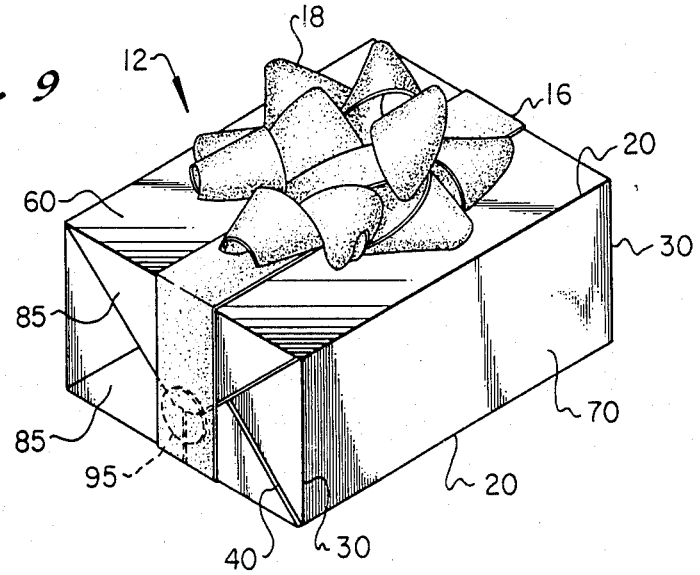
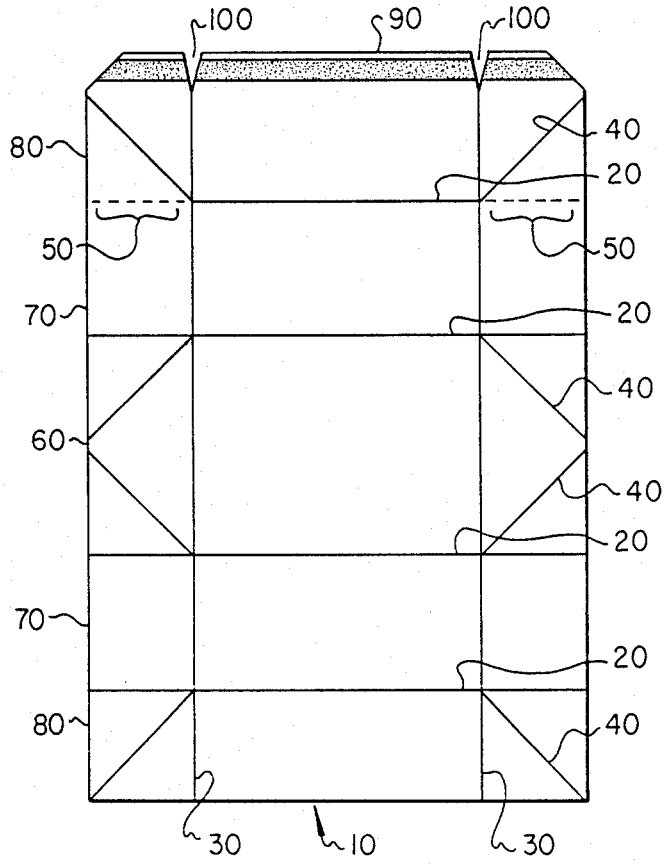
Fig. 1

PREFABRICATED GIFT BOX

TECHNICAL FIELD

The present invention relates to the packaging of gift items, and in particular to the packaging of articles such as rectangular boxes which may contain gift items such as jewelry.

BACKGROUND OF THE INVENTION

Currently, it is expensive, inconvenient, and time-consuming for shops and department stores to gift wrap items purchased by customers. Conventional gift wrapping requires store personnel to measure and cut gift wrapping paper from a roll, wrap the gift article in the gift wrapping paper, and seal the package with clear adhesive tape. This operation takes a substantial amount of employee time, thereby creating a significant labor expense. Furthermore, additional expense is incurred due to the inevitable waste of gift wrapping material resulting from inadvertent mismeasurement of the paper, accidental tearing of the gift wrapping material and the generation of unusable pieces of gift wrapping material.

Many attempts have been made in the past to create an expensive, preformed gift box that could be rapidly assembled and would present the appearance of a gift-wrapped package. Such attempts to create preformed gift boxes have been largely unsuccessful because these preformed gift boxes were either too complicated, involving a multitude of flaps, tabs, and slits, therefore being difficult to assemble, or they were aesthetically unpleasing in that they did not present the appearance of a gift-wrapped package. Furthermore, many of the prior attempts to create a preformed gift box required almost as much time to assemble the preformed box as was required to conventionally gift wrap an article.

SUMMARY OF THE INVENTION

The present invention provides a gift box which alleviates the problems presented by conventional gift wrapping and prior art preformed boxes. Particularly, the present invention provides a preformed gift box which may be easily stored and assembled in a few seconds, presenting the appearance of conventional gift wrapping.

In contrast to many prior art preformed gift boxes which are complicated and difficult to assemble, the present invention provides a gift box which is extremely simple and convenient to assemble. As many gift items are extremely fragile, the present invention provides a gift box which will protect the gift item from injury. Simultaneously, the gift box of the present invention is inexpensive and can be manufactured with minimum cost.

The gift box of the present invention is formed from a retangular blank of suitable material which is coated or overlaid on one or both sides with a decorative finish. The blank is formed into an open-ended rectangular box by folding the sheet along score lines and overlapping and gluing opposing sides of the sheet. The open-ended rectangular box thus formed may be collapsed and stored in a flattened state, minimizing storage space requirements.

The gift box of the present invention is formed with unique end closure sections, allowing the box to be assembled in seconds. A combination of score lines and perforated score lines are used to weaken the structure of the end closure sections of the open-ended rectangular box and define fold lines. Another unique feature of the end closure sections is that the rectangular sheet that forms the box is notched and trimmed to prevent the overlapped and glued sections of the sheet from impeding the folding process. The unique construction of the end closure sections allows the gift box to be rapidly and easily assembled, presenting the appearance of conventional gift-wrapping.

The advantages and practicality of the present invention are more apparent when considered in light of the operation of a typical department store or jewelry store. For example, in a jewelry store, five or six standard size jewelry boxes are typically used to package different gift items, such as rings, watches, necklaces, and bracelets. The gift box of the present invention may be manufacured in sizes conforming to the standardized jewelry boxes. Consequently, when a customer purchases an item such as a necklace, the jewelry store employee will place the necklace in the appropriate jewelry box, and select the corresponding gift box of the present invention. The employee would then "gift wrap" the necklace in the gift box of the present invention, and if desired, a ribbon and bow would be placed on the gift box. "Gift wrapping" the necklace with the gift box of the present invention would be accomplished in a matter of seconds. Alternatively, conventionally gift wrapping the necklace would require several minutes of the employee's time and additional labor expense, especially during the holiday seasons when additional employees are hired exclusively to gift wrap presents.

BRIEF DESCRIPTION OF DRAWINGS

A more complete understanding of the invention and its advantages will be apparent from the Detailed Description taken in conjunction with the accompanying Drawings, in which:

FIG. 1 is a top view of the rectangular blank from which the gift box is formed illustrating score lines which facilitate assembly of the gift box;

FIG. 9 is a perspective view of the gift box of the subject invention, assembled with a ribbon and a bow applied thereto;

DETAILED DESCRIPTION

Figure 3:
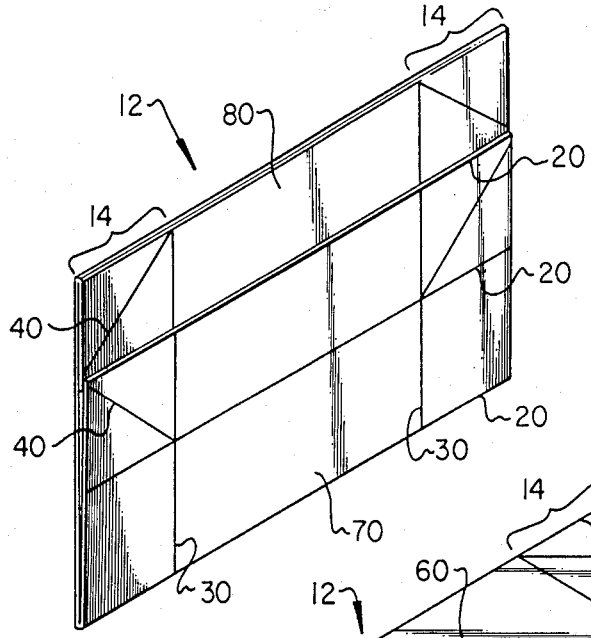
FIG. 3 is a perspective view of the gift box collapsed to its flattened state which minimizes the amount of space required for storage.

Referring to FIG. 1, a rectangular blank 10 of suitable material is illustrated with: lateral score lines 20; longitudinal score lines 30; diagonal score lines 40; and perforated sections 50 of lateral score lines 20; it being understood that the corresponding sections of all the lateral score lines are perforated in a like manner.

A top wall panel 60 is flexibly connected to sidewall panels 70 along lateral score lines 20. Sidewall panels 70 are flexibly connected to bottom wall panels 80 along lateral score lines 20.

Figure 2:
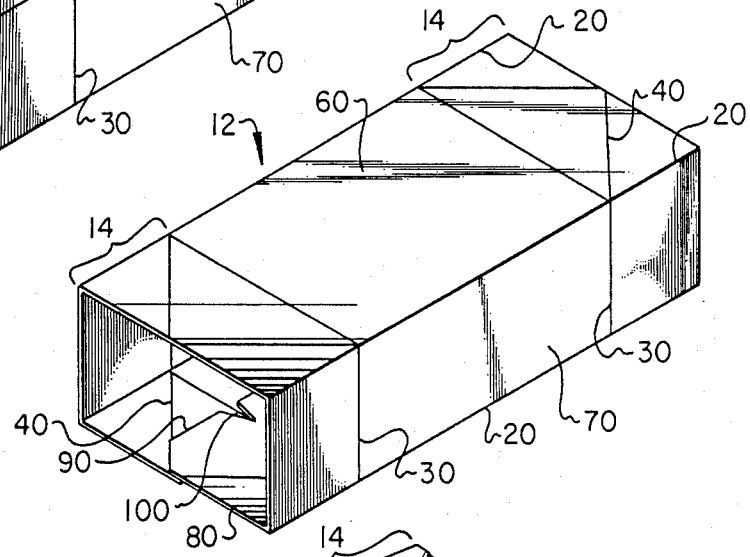
FIG. 2 is a perspective view of the gift box illustrating the rectangular blank from which the box is formed, folded and assembled into an open-ended, rectangular box.

Turning now to FIG. 2, the rectangular blank 10 of FIG. 2 is shown folded into a rectangular open-ended box 12. An important feature of the gift box illustrated in FIGS. 1 and 2 is that the interior lateral edge 90 of bottom wall panel 80 is formed with two notches 100. The notches 100 are bisected by the longitudinal score lines 30, and cut to a depth equal to the overlap of the bottom wall panels 80. FIGS. 1 and 2 also illustrate that the outside corners of the interior lateral edge 90 are trimmed off to a depth equal to the overlap of the bottom wall panels 80, at an angle corresponding to the diagonal score lines 40. Thus, when the end closure portions 14 of the box 12 defined by the longitudinal score lines 30 are subsequently folded, the overlap of the bottom wall panels 80 will not impede folding along longitudinal score lines 30 or diagonal score lines 40.

FIG. 3 illustrates the rectangular box 12 shown in FIG. 2 in a collapsed position for storage requiring a minimal amount of space.

Figure 4:
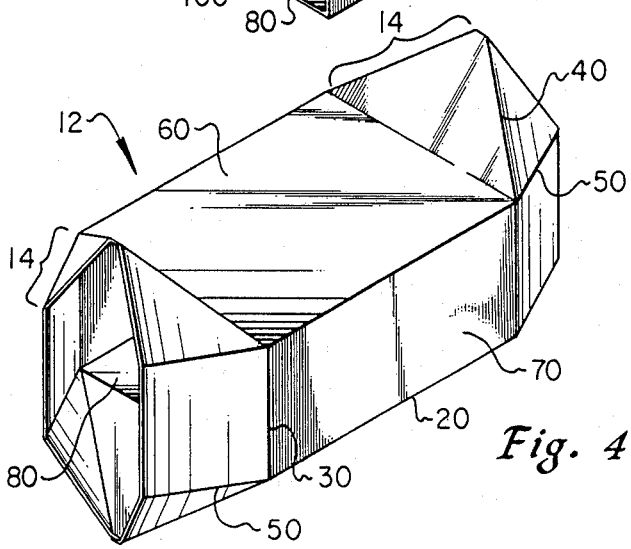
FIGS. 4–8 are perspective views of the gift box illustrating the steps in the process of closing the gift box.
Figure 5:
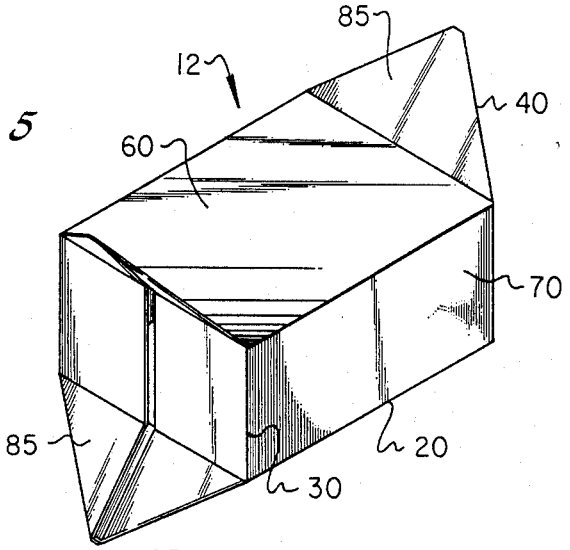

As illustrated in FIG. 4, the box is closed by depressing the rectangular portions of the sidewall panels 70 defined by the longitudinal score lines 30 and the perforated sections 50 of the lateral score lines 20 inwardly. Simultaneously, the rectangular portions of the top wall panel 60, and bottom wall panels 80 defined by the longitudinal score lines 30 and the perforated sections 50 of the lateral score lines 20, begin to fold outwardly on diagonal score lines 40.

Figure 6:
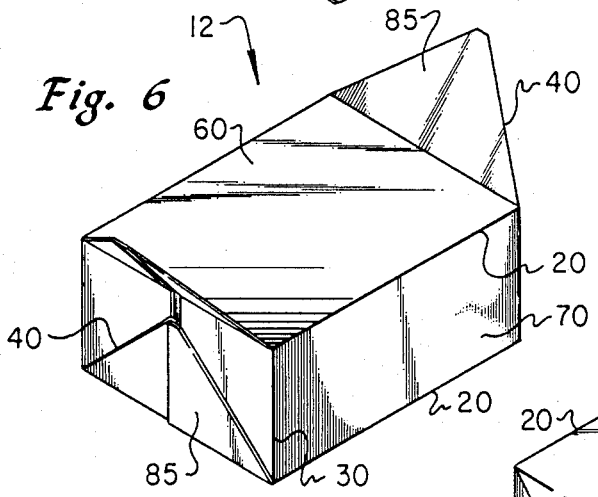
Figure 7:
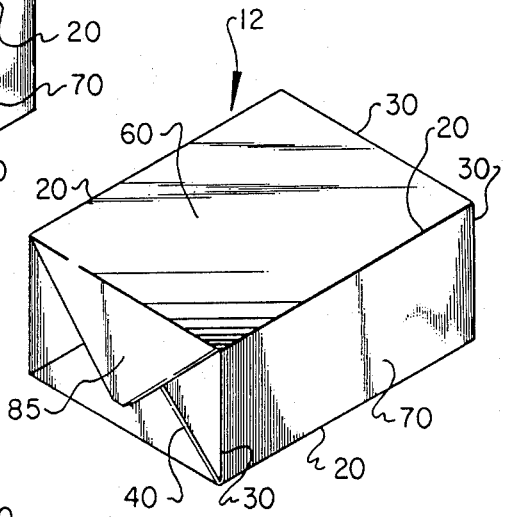
Figure 8:
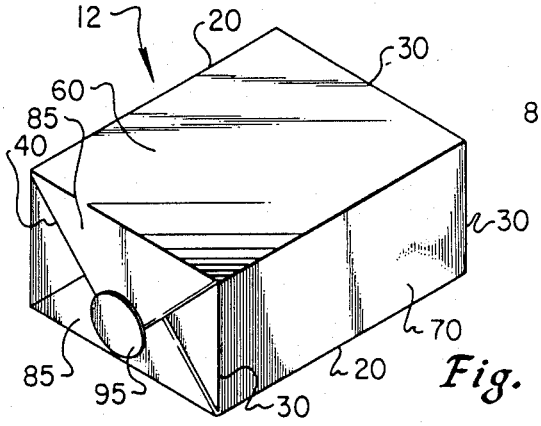

As shown in FIGS. 5 through 8, the rectangular portions of the sidewall panels 70 defined by the longitudinal score lines 30 and the perforated sections 50 of the lateral score lines 20, are folded inward until they are perpendicular to the sidewall panels 70. The rectangular portions of the top wall panel 60 and bottom wall panels 80 defined by the longitudinal score lines 30 and the perforated sections 50 of the lateral score lines 20 simultaneously fold into triangular flaps 85 which are then folded over one another as illustrated in FIGS. 6 and 7. The gift box 12 may then be sealed by using a piece of transparent adhesive tape or a gummed label 95 to secure the triangular flaps 85 in position as illustrated in FIG. 8.

Referring to FIG. 9, the gift box 12 is illustrated in its completed assembled form with a ribbon 16 and bow 18 attached.

The folding process described above and illustrated in FIGS. 4 through 7 is permitted by the unique construction of the box. As noted above, and illustrated in FIGS. 1 and 2, the interior lateral edge 90 of the bottom wall panel 80 is notched and trimmed so that the overlap of the bottom wall panels 80 will not impede folding along the longitudinal score lines 30 or the diagonal score lines 40. Likewise, the perforated sections 50 of the lateral score lines 20 weaken the structure of the end closure portions 14 of the gift box 12, permitting the end closure portions 14 of the gift box 12 to be easily folded along the longitudinal score lines 30 and the diagonal score lines 40. Furthermore, when the box is completely assembled, as illustrated in FIG. 7, the perforated sections 50 of the lateral score lines 20 are completely hidden and thus do not mar the exterior appearance of the gift box 12.

Figure 10:
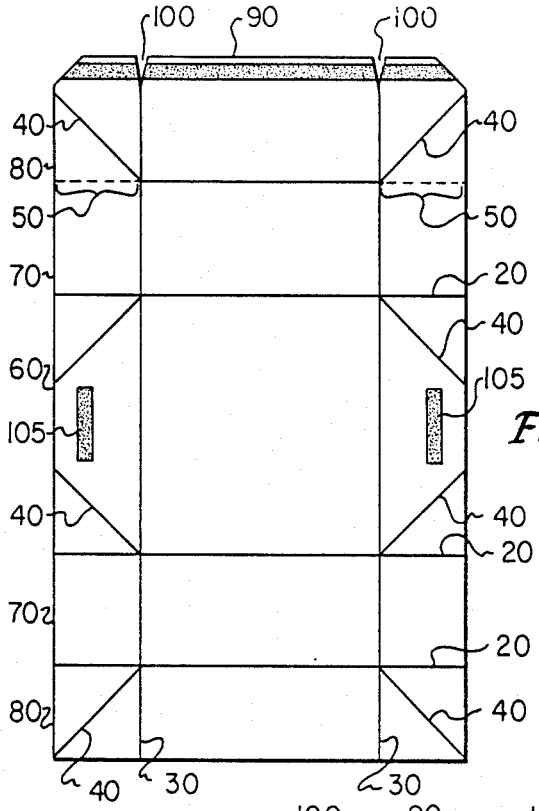
FIG. 10 is a top view of a rectangular blank illustrating an alternate embodiment of the gift box of the subject invention.
Figure 11:
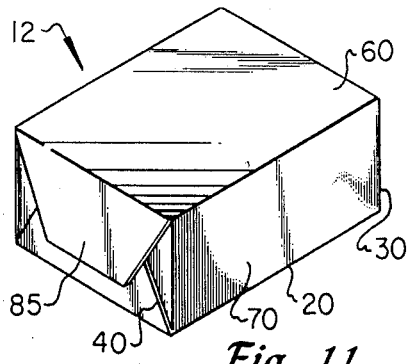
FIG. 11 is a perspective view of the alternate embodiment of FIG. 10 shown assembled and sealed.

FIGS. 10 and 11 illustrate a second embodiment of the gift box 12 wherein the flaps 85 formed by the sections of the top wall panel 60 and bottom wall panels 80 defined by the longitudinal score lines 20 and the perforated sections 50 of the lateral score lines 20 assume the form of a truncated triangle. The top wall panel 60 of the gift box may also be formed with presure sensitive adhesive 105 so as to facilitate sealing the box and eliminate the need for adhesive tape or a gummed label.

Figure 13:
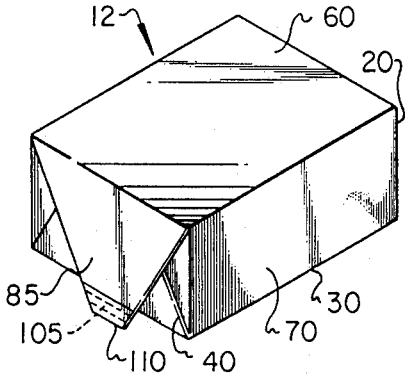
FIG. 13 is a perspective view of the gift box of FIG. 12 illustrated in its assembled form.
Figure 12:
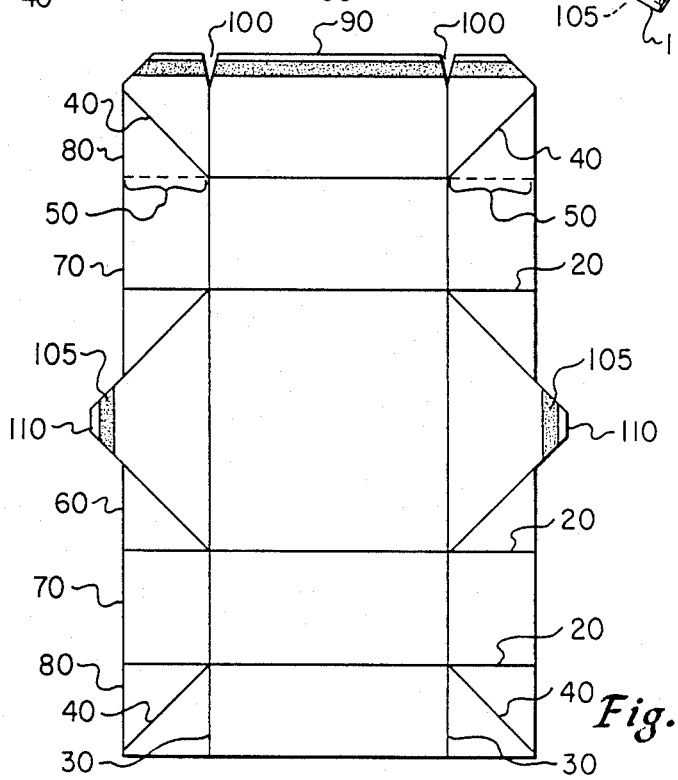
FIG. 12 is a top view of a rectangular blank comprising another alternate embodiment of the gift box of the subject invention.

FIGS. 12 and 13 illustrate a third embodiment of the gift box 12 wherein the top wall panel 60 is formed with end enclosure flaps 110. When the box is assembled, the end enclosure flaps 110 are folded over the bottom wall of the gift box 12. The end enclosure flaps 110 facilitate sealing the gift box while increasing the structural strength of the gift box. The end enclosure flaps 110 may also be formed with pressure sensitive adhesive 105 applied to the end enclosure flaps 110 to facilitate sealing the box.

While the invention has been described in connection with the illustrated embodiments, it is not intended to limit the scope of the invention to the particular forms set forth, but, on the contrary, it is intended to cover such alternatives, modifications, and equivalents as may be included within the spirit and scope of the invention as defined in the appended claims.

We claim:

1. A collapsible box, comprising;

a substantially rectangular blank of a suitable material having a central top wall panel flexibly connected to sidewall panels along lateral score lines, said sidewall panels flexibly connected to respective bottom wall panels along lateral score lines, the lateral edges of said bottom wall panels partially overlapping each other with said overlapped portions being fastened together, thereby forming an open-ended rectangular body;

end closure means integrally formed with said open-ended rectangular body by means of a longitudinal score line formed on each end of said panels forming said body parallel to and equally distant from the ends of said body;

a V-shaped notch cut in each end of the overlapped interior bottom wall panel such that said notch is bisected by a respective longitudinal score line; said V-shaped notches being cut to the depth of the overlap of said bottom wall panels, the outer corners of said interior bottom wall panel being trimmed off commencing at the depth of the overlap of said bottom wall panels and extending inwardly to said lateral interior edge;

diagonal score lines formed in the top and bottom wall panels, said diagonal score lines bisecting the angles formed by the intersections of the longitudinal and lateral score lines and extending outwardly to the end of said rectangular body; and said lateral score lines being perforated from the intersection of the lateral and longitudinal score lines outwardly to the end of said rectangular body, said perforated sections of said lateral score lines cooperating with said longitudinal score lines, diagonal score lines and V-shaped notches to allow the rectangular portions of said sidewalls defined by the longitudinal score lines and the perforated section of the lateral score lines to be folded inwardly while simultaneously folding the rectangular portions of the top and bottom walls defined by the longitudinal score lines and the perforated sections of the lateral score lines into flaps; said flaps being folded over said rectangular sidewall sections to form end walls.

2. A collapsible box in accordance with claim 1, further comprising end closure flaps flexibly connected to each end of said top wall panel, said rectangular end closure flaps folding over and partially overlapping said bottom wall panels.

3. A collapsible box in accordance with claim 1, further comprising a decorative coating or overlay applied to one or both sides of said blank of suitable material such that the box formed presents the appearance of a gift-wrapped package.

4. A collapsible box in accordance with claim 2, further comprising a decorative coating or overlay applied to one or both sides of said blank of suitable material such that the box formed presents the appearance of a gift-wrapped package.

5. A collapsible box in accordance with claim 1, further comprising a pressure-sensitive adhesive applied to said flap.

6. A collapsible box in accordance with claim 2, further comprising a pressure-sensitive adhesive applied to said end closure flap.

* * * * *